US005998983A

United States Patent [19]

Gerber

[11] Patent Number: 5,998,983

[45] Date of Patent: Dec. 7, 1999

[54] DEVICE FOR GENERATING A DC REFERENCE VOLTAGE

[75] Inventor: Rémi Gerber, Nantes, France

[73] Assignee: MHS, Mantes, France

[21] Appl. No.: 09/207,614

[22] Filed: Dec. 9, 1998

[30] Foreign Application Priority Data

Dec. 10, 1997 [FR] France ..... 97 15626

[51] Int. Cl.[6] ..... G05F 3/20

[52] U.S. Cl. ..... 323/313; 327/538

[58] Field of Search ..... 323/312, 313, 323/314; 327/538, 540

[56] References Cited

U.S. PATENT DOCUMENTS

| | | | |
|---|---|---|---|
| 5,051,686 | 9/1991 | Schaffer | 323/313 |
| 5,281,906 | 1/1994 | Thelen, Jr. | 323/313 |
| 5,315,231 | 5/1994 | Linder et al. | 323/315 |
| 5,373,226 | 12/1994 | Kimura | 323/313 |
| 5,747,978 | 5/1998 | Gariboldi et al. | 323/313 |
| 5,783,935 | 7/1998 | Kyung | 323/313 |
| 5,796,244 | 8/1998 | Chen et al. | 323/313 |

FOREIGN PATENT DOCUMENTS 0 786 776 A1 7/1997 European Pat. Off. .

OTHER PUBLICATIONS

"Temperature–Compensation Circuit Techniques For High–Density CMOS DRAMS", Dong–Sun Min Et Al., Proceedings of the Symposium on VLSI Circuits, OISO, JP., May 30–Jun. 1, 1991, No. SYMP. 5, May 30, 1991, pp. 125–126.

"Low–Power On–Chip Supply Voltage Conversion Scheme For Ultrahigh–Density DRAM'S", Daisaburo Takashima Et Al., IEICE Transactions On Electronics, vol. E76–C, No. 5, May 1, 1993, pp. 844–849.

*Primary Examiner*—Adolf Denske Berhane
*Attorney, Agent, or Firm*—Larson & Taylor

[57] ABSTRACT

A device that generates a DC reference voltage approximately equal to half a DC supply voltage. It includes an input stage forming a first potentiometric divider comprising two branches having an asymmetric behavior in response to variations in the room and/or operating temperature, and supplying a first DC voltage (NBGP), an intermediate stage forming a resistive and capacitive filter, which eliminates the dynamic component of the first DC voltage (NGBP) and supplies a second DC voltage (NARF), and an output stage forming a second potentiometric divider comprising two branches also having an asymmetric behavior of which the voltage variations are smaller than those of the first divider comprising in addition a logic inverter function, and supplying a third DC voltage (NREF), the variations of which are the inverse of those in the second DC voltage (NARF), the variations in the latter being thus compensated.

3 Claims, 3 Drawing Sheets

DEVICE FOR GENERATING A DC REFERENCE VOLTAGE

BACKGROUND OF THE INVENTION

1. Field of the Invention

The present invention concerns a device for generating a DC reference voltage. More exactly, the invention relates to a device enabling an output reference voltage approximately equal to half a DC supply voltage provided to this device to be obtained.

2. Brief Description of the Prior Art

Numerous reference voltage generating circuits are known. However, these circuits generally include passive elements and/or bipolar transistors. When attempts are made to integrate such components in a silicon matrix, of the logic type, several drawbacks are encountered. On the one hand, a passive element such as an ohmic resistance, for example, often gives great variations in its value, of the order of magnitude of ±20%. On the other hand, some of these components are relatively expensive: for example, a bipolar transistor, longer to manufacture than an MOS transistor, is more expensive, and is in addition more difficult to integrate.

OBJECTS OF THE INVENTION

The object of the present invention is to overcome the aforementioned drawbacks by proposing a device generating a DC reference voltage made exclusively from MOS transistors. Using such transistors has the advantage of making possible, compared with the aforementioned components, at low cost, easier integration, a gain in integration density, low static power consumption and the achievement of a reference voltage with a precision of about ±1%.

The operating principle of the proposed device is based on compensation for variations in voltage as a function of the room and/or operating temperature of the device, the variations in operating temperature being related to the quality of the manufacturing process of the device.

SUMMARY OF THE INVENTION

In order to meet the aforementioned objective, the present invention proposes a device for generating a DC reference voltage approximately equal to half a DC supply voltage provided to this device, remarkable in that it includes:

an input stage, forming a first potentiometric divider comprising a first branch connected to the power supply and a second branch connected to the reference potential or ground potential, the first and second branches having an asymmetric behaviour in response to variations in the room and/or operating temperature, the variations in operating temperature being linked to the quality of the manufacturing process of the device, this input stage supplying a first DC voltage NBGP with a static component and a dynamic component;

an intermediate stage, forming a resistive and capacitive filter, which receives the first DC input voltage NGBP, eliminates its dynamic component, and supplies a second DC output voltage NARF; and an output stage, forming a second potentiometric divider comprising a first branch connected to the power supply and a second branch connected to the reference potential or ground potential, the first and second branches of the second potentiometric divider having an asymmetric behaviour similar to the behaviour of the first and second branches of the first potentiometric divider, the relative voltage variations of the second divider as a function of the room and/or operating temperature being however smaller than the relative variations in voltage of the first divider, the variations in operating temperature being linked to the quality of the manufacturing process, this output stage comprising in addition a logic inverter function, this output stage supplying a third DC voltage NREF, the variations of which as a function of the room and/or operating temperature, the variations in operating temperature being linked to the quality of the manufacturing process, are the inverse of those of the second DC voltage NARF, the variations in the second DC voltage NARF being thus compensated.

In a particular embodiment, the first branch of the input stage includes a first p-type MOS transistor and a second n-type MOS transistor, the gate of the second transistor and the drain of the first transistor being connected to the power supply, the source of the first transistor being connected to the drain of the second transistor, the second branch of the input stage includes a third p-type MOS transistor and a fourth n-type MOS transistor, the gate of the third transistor and the source of the fourth transistor being connected to the reference potential, the source of the third transistor being connected to the drain of the fourth transistor, the gates of the first and fourth transistors being connected to each other, the source of the second transistor being connected to the drain of the third transistor and to the gates of the first and fourth transistors, and constituting the output of the input stage.

In a particular version, the intermediate stage includes a first capacitive cell, comprising a fifth p-type MOS transistor and a sixth n-type MOS transistor, the gates of the fifth and sixth transistors being connected to each other and to the output of the input stage, the source and the drain of the fifth transistor being connected to the power supply, the source and the drain of the sixth transistor being connected to the reference potential, a resistive cell, comprising a seventh n-type MOS transistor and an eighth p-type MOS transistor, the gate of the seventh transistor being connected to the power supply, the gate of the eighth transistor being connected to the reference potential, the source of the seventh transistor and the drain of the eighth transistor being connected to each other and to the gates of the fifth and sixth transistors of the first capacitive cell and having a potential equal to the first DC voltage NBGP, the drain of the seventh transistor and the source of the eighth transistor being connected to each other and having a potential equal to the second DC voltage NARF, and a second capacitive cell, comprising a ninth p-type MOS transistor and a tenth n-type MOS transistor, the source and the drain of the ninth transistor being connected to the power supply, the source and the drain of the tenth transistor being connected to the reference potential, the gates of the ninth and tenth transistors being connected to each other and to the drain of the seventh transistor of the resistive cell and constituting the output of the intermediate stage.

In a particular embodiment, the first branch of the output stage includes an eleventh p-type MOS transistor and a twelfth n-type MOS transistor, the gate of the twelfth transistor and the drain of the eleventh transistor being connected to the power supply, the source of the eleventh transistor being connected to the drain of the twelfth transistor, the second branch of the output stage includes a thirteenth p-type MOS transistor and a fourteenth n-type MOS transistor, the gate of the thirteenth transistor and the source of the fourteenth transistor being connected to the reference potential, the source of the thirteenth transistor being connected to the drain of the fourteenth transistor, the gates of the eleventh and fourteenth transistors being connected to each other and to the output of the intermediate stage, the source of the twelfth transistor being connected to the drain of the thirteenth transistor and constituting the output of the output stage.

The invention also proposes the use of a device of the above type in an integrated circuit.

Other features and advantages of the present invention will emerge from reading the following detailed description of particular versions, given as non-restrictive examples.

BRIEF DESCRIPTION OF THE DRAWINGS

The present invention refers to the accompanying drawings, in which.

Figure 1:
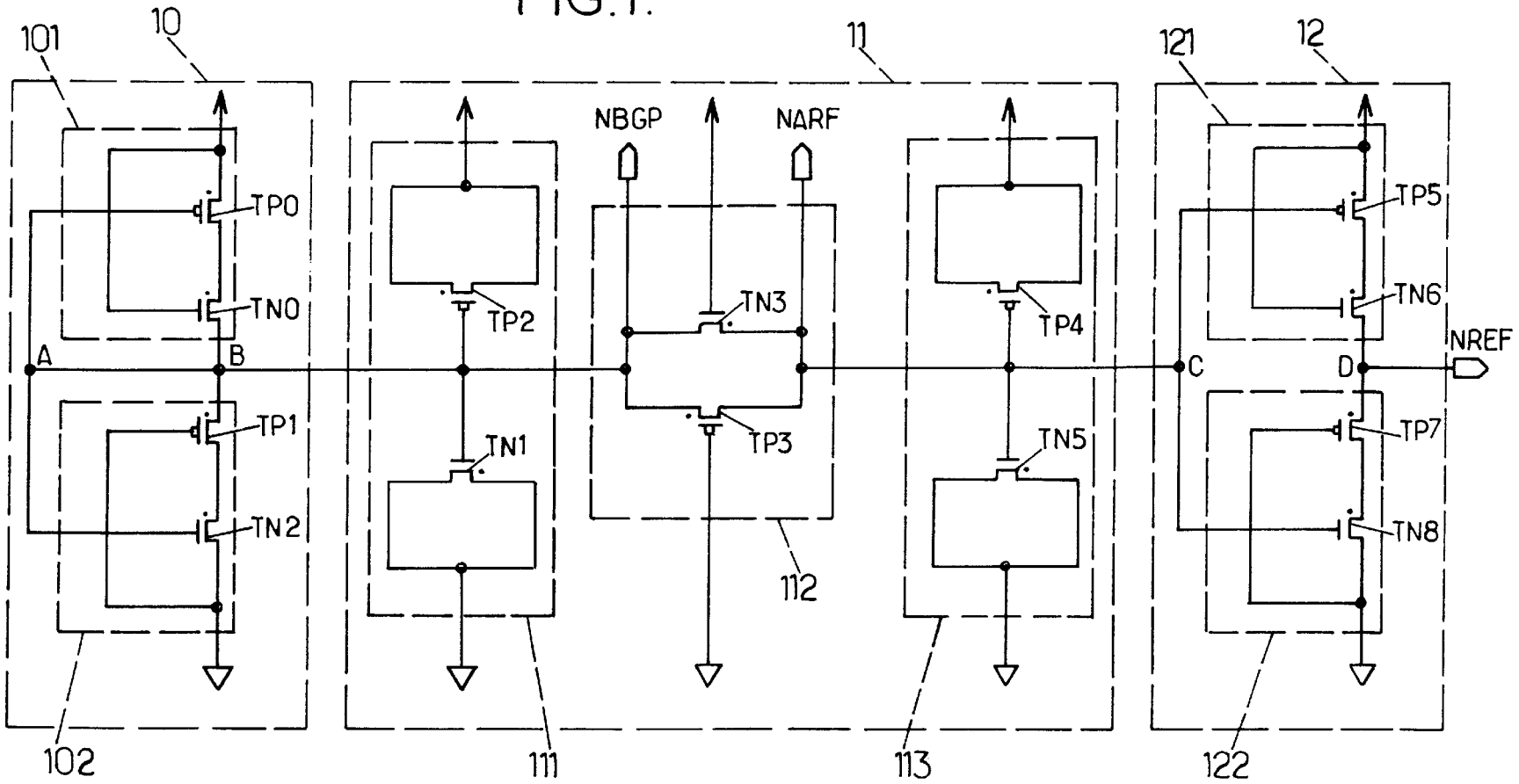
FIG. 1 is an MOS transistor based electrical circuit diagram of the device of the invention, in a particular version.

As FIG. 1 shows, the device for generating a DC reference voltage of the invention is composed of three main parts: an input stage 10, an intermediate stage 11 and an output stage 12.

In FIG. 1, the arrows denote the connection to a DC supply voltage, for example of 5V, or of 3V. The triangles denote the connection to the reference potential.

The input stage 10 forms a voltage divider, which supplies a first DC output voltage NBGP substantially equal to half the supply voltage. The input stage 10 comprises two branches 101 and 102. The first branch 101 is connected to the power supply and the second branch 102 is connected to the reference potential. The constituent elements of each branch are chosen so that when the room and/or operating temperature varies, each branch reacts differently.

In the particular embodiment shown in FIG. 1, the two branches 101, 102 are made from p-type and n-type MOS transistors. Throughout what follows, the transistors bearing a reference sign commencing "TP" are p-type MOS transistors, and the transistors bearing a reference sign commencing "TN" are n-type transistors.

The first branch 101 includes a first transistor TP0 and a second transistor TN0. The gate of the second transistor TN0 and the drain of the first transistor TP0 are connected to the power supply. The source of the first transistor TP0 is connected to the drain of the second transistor TN0, i.e. the first and second transistors TP0 and TN0 are connected in series.

The second branch 102 includes a third transistor TP1 and a fourth transistor TN2 connected in series: the gate of the third transistor TP1 and the source of the fourth transistor TN2 are connected to the reference potential, and the source of the third transistor TP1 is connected to the drain of the fourth transistor TN2.

The two branches 101, 102 are connected to each other as follows: the gates of the first and fourth transistors TP0 and TN2 are connected to each other at a point A; the source of the second transistor TN0 is connected to the drain of the third transistor TP1 at a point B, and to the gates of the first and fourth transistors TP0 and TN2, by connection of the points A and B. The logic inverter function of such a circuit is short-circuited through the connection between these points A and B.

As shown above, when the room and/or operating temperature varies, the branches 101 and 102 do not behave in the same way. The length L of the channel of the transistors TP0, TN0, TP1, TN2 is chosen in such a way that when the temperature increases, the threshold voltage of the first and second transistors TP0, TN0 increases more strongly than the threshold voltage of the third and fourth transistors TP1, TN2.

A reminder is given of the electrical behaviour equation of PMOS and NMOS transistors:

$$I_{ds} = \frac{W}{2L} \cdot \mu \cdot C_{ox} \cdot (V_{GS} - V_T)^2$$

where $I_{ds}$ denotes the drain-source current, W denotes the width of the channel, L denotes the length of the channel, $\mu$ denotes electrical mobility, $C_{ox}$ denotes the gate oxide capacity per unit area, $V_{GS}$ denotes the voltage between the gate and the source, and $V_T$ denotes the threshold voltage of the transistor under consideration.

When the temperature increases, given that $V_T$ increases more strongly for the (TP0, TN0) assembly than for the (TP1, TN2) assembly, the impedance, linked to the inverse of the drain-source current, which decreases more strongly for the (TP0, TN0) assembly than for the (TP1, TN2) assembly, increases more strongly for the (TP0, TN0) assembly than for the (TP1, TN2) assembly. The two branches therefore have an asymmetric behaviour in response to variations in temperature. When the operating temperature increases, this asymmetry enables generation of a reduction in the first DC voltage NBGP supplied by the input stage. Conversely, when the operating temperature decreases, an increase of the first DC voltage NBGP is likely to appear.

These variations in operating temperature are linked to the quality of the manufacturing process of the transistors and to the room temperature. Indeed, in the case of a so-called slow manufacturing process, i.e with relatively poor manufacturing parameters (precision of machines used, quality of diffusion, etc.), the transistors obtained have a relatively low commutation rate. Conversely, in the case of a so-called fast manufacturing process, with relatively good parameters, the transistors made have a higher commutation rate. The slower the manufacturing process, the higher the threshold voltage of the transistor, which reduces all the more the effect of variations in the operating temperature and in the room temperature on the voltage.

Figure 2:
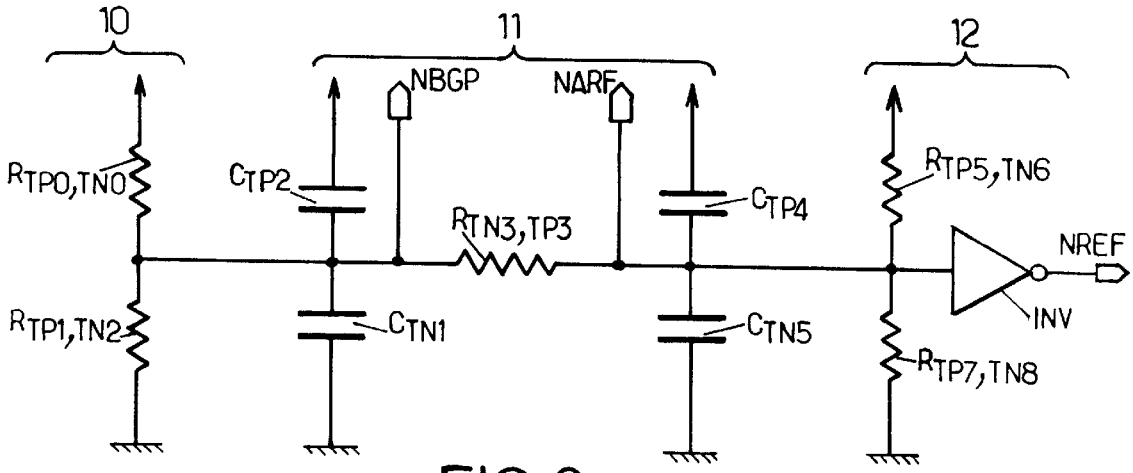
FIG. 2 is an equivalent electrical circuit diagram to FIG. 1, showing the resistive, capacitive and thermal inversion functions fulfilled by the different transistors.

As is shown on the equivalent electrical circuit diagram in FIG. 2, the input stage 10 is equivalent to a potentiometric divider with two resistances, the first of which, $R_{TP0,TN0}$, is the equivalent of the first and second transistors TP0, TN0, and the second, $R_{TP1,TN2}$, is the equivalent of the third and fourth transistors TP1, TN2.

Figure 3:
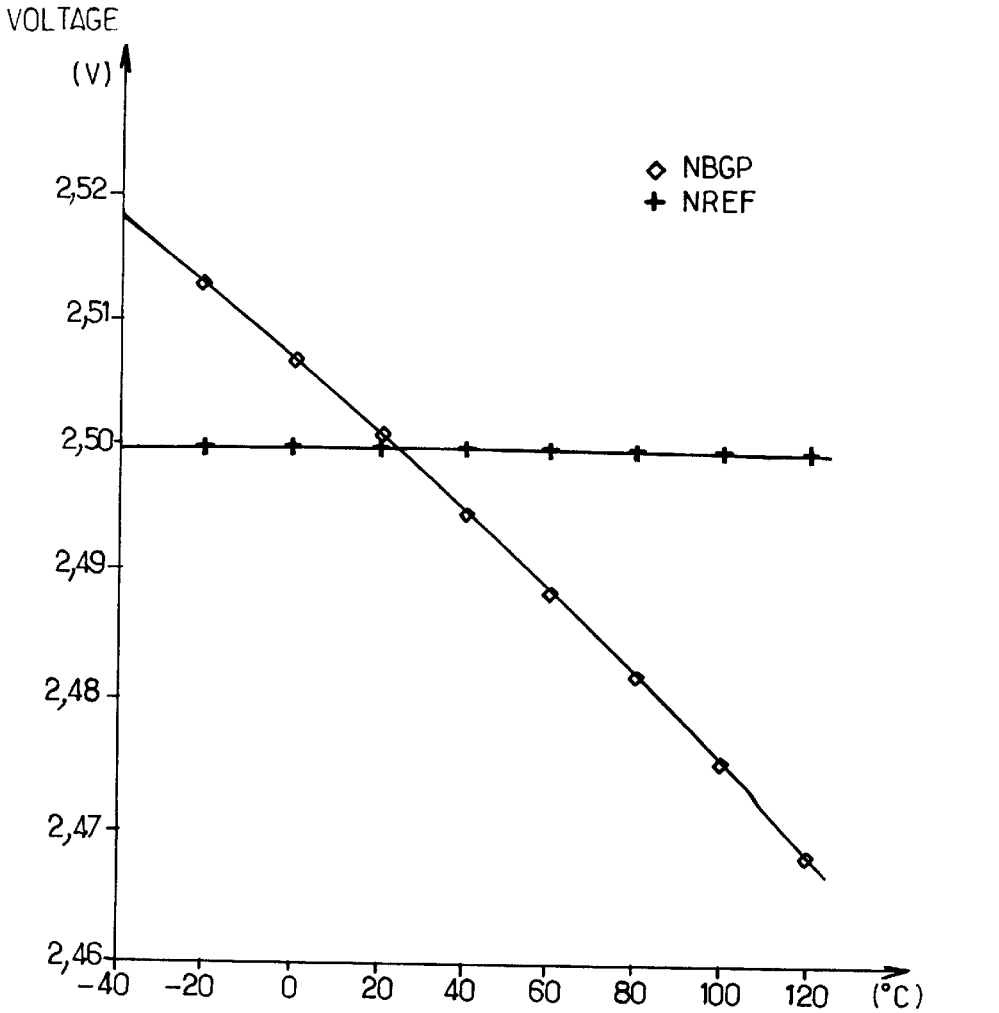
FIG. 3 is a graph showing the third DC voltage NREF and the variation in the first DC voltage NBGP as a function of the room temperature, for a DC supply voltage of 5 volts and for a range of room temperatures from −40° C. to +125° C.

FIG. 3 shows the variations in the first DC voltage NBGP as a function of the temperature in a particular example, where the DC supply voltage is equal to 5V, and where the room temperature is made to vary between 40° C. and +125° C. An approximately linear fall in NBGP can be observed as the temperature increases. By way of comparison, the third DC output voltage NREF obtained from the device for generating DC voltage has also been shown. It can be seen that the voltage NREF is approximately constant and equal to 2.5V, i.e. half the DC supply voltage.

Point B of the input stage 10 is connected to the input of the intermediate stage 11. The role of the intermediate stage 11 is to provide a protection against commutation noise, of the conducted noise or radiated noise type, generated by the different elements of the surrounding circuit.

The first DC voltage NBGP supplied by the input stage 11 has a static component and a dynamic component. The intermediate stage 11 carries out a resistive and capacitive type filtering of the analogue value NBGP in order to eliminate its dynamic component.

In a particular embodiment, the intermediate stage 11 includes a resistive cell 112 flanked by two capacitive cells 111 and 113.

In the particular embodiment shown in FIG. 1, the first capacitive cell 111 comprises a fifth transistor TP2 and a sixth transistor TN1. The gates of TP2 and TN1 are connected to each other and to the point B of the input stage 10. The source and the drain of TP2 are connected to the power supply, and the source and the drain of TN1 are connected to the reference potential.

As FIG. 2 shows, the first capacitive cell 111 is equivalent to a pair of capacitors, the first of which, $C_{TP2}$, is formed by the fifth transistor TP2, and the second, $C_{TN1}$, is formed by the sixth transistor TN1.

The resistive cell 112 comprises a seventh transistor TN3 and an eighth transistor TP3. The gate of TN3 is connected to the power supply. The gate of TP3 is connected to the reference potential. The source of TN3 and the drain of TP3 are connected to each other and to the gates of the fifth and sixth transistors TP2 and TN1 of the first capacitive cell 111, and have a potential equal to the first DC voltage NBGP.

The resistive cell 112 is equivalent to a resistance $R_{TN3,TP3}$ shown in the equivalent diagram in FIG. 2.

The second capacitive cell 113 comprises a ninth transistor TP4 and a tenth transistor TN5. The source and drain of TP4 are connected to the power supply. The source and drain of TN5 are connected to the reference potential. The gates of TP4 and TN5 are connected to each other and to the drain of the seventh transistor TN3 and to the source of the eighth transistor TP3 of the resistive cell, and constitute the output of the intermediate stage. The second capacitive cell 113, of similar structure to the first capacitive cell 111, also has a similar equivalent diagram, comprising a pair of capacitors shown in FIG. 2, the first of which $C_{TP4}$, is formed by the ninth transistor TP4, and the second, $C_{TN5}$, is formed by the tenth transistor TN5.

The drain of the seventh transistor TN3 and the source of the eighth transistor TP3 are connected to each other and have a potential equal to a second DC voltage NARF.

Figure 4:
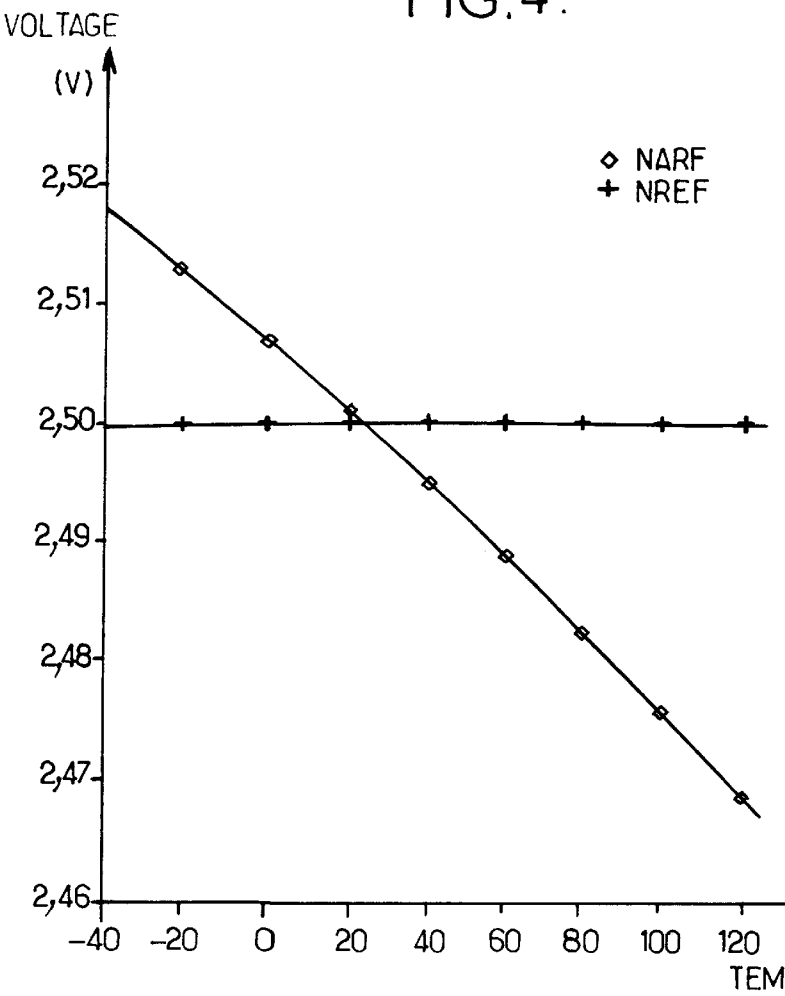
FIG. 4 is a graph showing the third DC voltage NREF and the change in the second DC voltage NARF as a function of the temperature, for a DC supply voltage of 5 volts and for a range of room temperatures from −40° C. to +125° C.

Variations in the voltage NARF as a function of temperature are shown by the graph in FIG. 4, in a particular example, where, in the same way as for the diagram in FIG. 3, the DC supply voltage is equal to 5V, and the room temperature is made to vary between −40° C. and +125° C. The NREF voltage has also been shown, by way of comparison. The variations in the second DC voltage NARF are approximately identical to those of the first DC voltage NBGP: an almost linear fall in NARF can be seen when the temperature increases.

It is further necessary to compensate this fall in order to obtain from the output device an approximately constant output voltage NREF equal to half the DC supply voltage. This is the function performed by the output stage 12, which fulfills a dual function of logic inversion and compensation for variations in voltage as a function of temperature.

In the particular embodiment shown in FIG. 1, the output stage 12 has a similar structure to that of the input stage 10, with the exception of points C and D which, unlike points A and B, are not connected to each other, which confers on the output stage 12, besides its function of potentiometric divider, that of a logic inverter.

The output stage 12 includes a first branch 121, which comprises an eleventh transistor TP5 and a twelfth transistor TN6, the gate of TN6 and the drain of TP5 being connected to the power supply, the source of TP5 being connected to the drain of TN6.

The output stage 12 also includes a second branch 122, which comprises a thirteenth transistor TP7 and a fourteenth transistor TN8, the gate of TP7 and the source of TN8 being connected to the reference potential, the source of TP7 being connected to the drain of TN8, the gates of TP5 and TN8 being connected to each other at point C, and to the output of the intermediate stage 11.

The source of TN6 is connected to the drain of TP7 at point D, which constitutes the output of the output stage 12, and of the whole device. Point D is at the NREF potential.

The channel lengths of the transistors TP5, TN6, TP7, TN8 are chosen in such a way that when the temperature varies, the threshold voltages of the transistors TP5 and TN6 vary more strongly than the threshold voltages of the transistors TP7 and TN8, and in such a way that the asymmetric behaviour of the two branches 121, 122, similar to that, already described, of the two branches 101, 102 of the input stage 10, induces variations in voltage of the same direction as those in the input stage, but smaller.

The output stage 12 acts in addition as an inverter towards the voltage variations induced by variations in temperature.

Thus, in the event of an increase in temperature for example, the NARF voltage, resulting from the filtering of the NBGP voltage which tends to decrease, also has a downward trend. The NREF voltage would also tend to decrease given the increase in temperature; however, given the logic inversion provided by the output stage 12, the downward trend of the NARF voltage is converted into an upward trend of the resulting NREF voltage, which enables in this way the delivered NREF voltage to be compensated.

Conversely, in the event of a fall in temperature, the NREF upward trend is compensated by the logic inversion of the NARF upward trend, which is expressed by a NREF downward trend compensating its upward trend.

Figure 5:
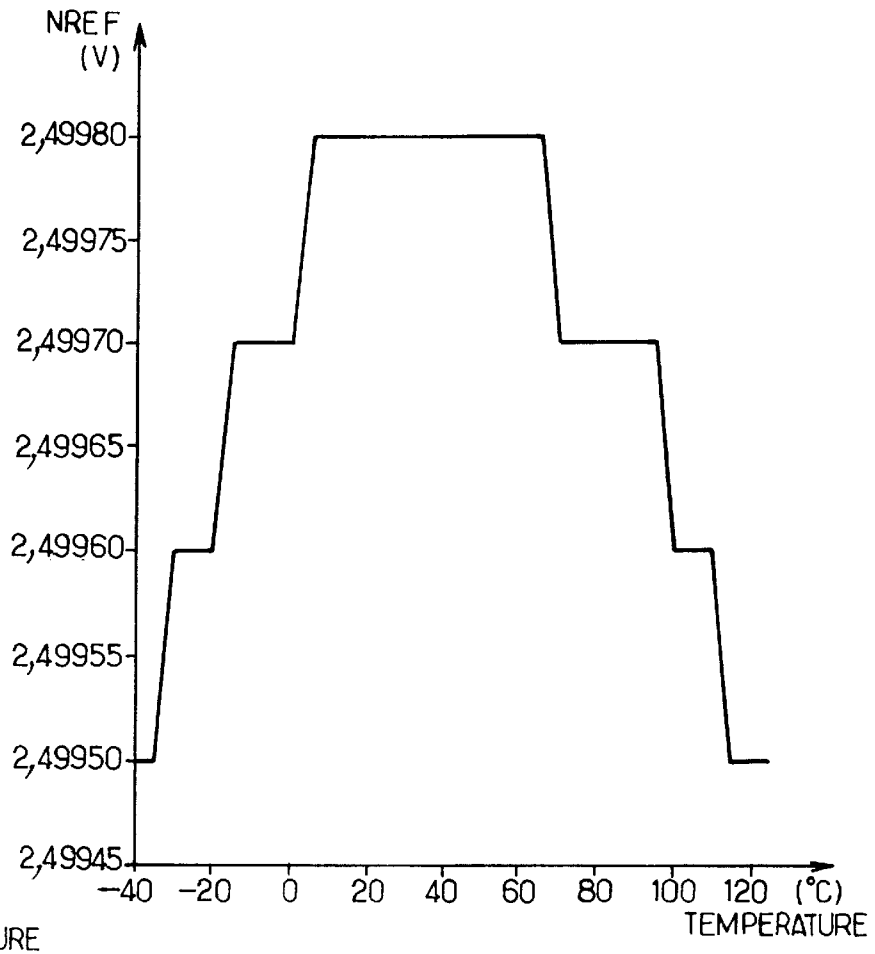
FIG. 5 is a graph showing the detail of the change in the third DC voltage NREF in the interval [2.4995V; 2.4998V], showing its very small variations, for a range of room temperatures from −40° C. to +125° C.

The result is that the NREF voltage experiences small variations, shown in a particular case in FIG. 5, where the DC supply voltage is 5V, and where the value of NREF has been measured for room temperatures varying from 40° C. to +125° C. It can be seen that NREF is stable and equal to 2.49980V for a range of temperatures approximately between +5° C. and +65° C., and has variations not exceeding $2.4998-2.4995=3.10^{-4}$V in the intervals of temperature [−40° C., +5° C.] and [+65° C., +125° C.]

As FIG. 2 shows, the output stage 12 is equivalent to a connection in series comprising, in cascade, on the one hand, a potentiometric divider with two resistances, and on the other hand, a logic inverter INV. The first resistance of the divider, $R_{TP5,TN6}$, is the equivalent of the eleventh and twelfth transistors TP5, TN6, and the second resistance of the divider, $R_{TP7,TN8}$, is the equivalent of the thirteenth and fourteenth transistors TP7, TN8.

In a particular version, which corresponds to the diagrams in FIGS. 3 to 5, the channel lengths and widths of the different transistors are chosen so that they verify the following relationships:

$L(TN2) \cong 4 \times L(TN0)$ $L(TN8) \cong 2 \times L(TN6)$ $L(TN6) \cong 2 \times L(TN0)$ $L(TP7) \cong 2 \times L(TP1)$ $W(TP3) \cong 2 \times W(TN3)$ where L and W denote the length and width respectively of the transistors the reference numbers of which are shown in brackets.

As previously described, the invention therefore enables generation of a reference voltage of half the supply voltage type. Tests have shown that the precision obtained is approximately ±1% for a power supply of 5V±10%

The invention can be used in numerous types of integrated circuits, for example for the generation of logic signals from a low amplitude signal the rest point of which is the reference voltage produced by the invention.

What is claimed:

1. A device for generating a DC reference voltage approximately equal to half a DC supply voltage provided to said device, said device including:

an input stage, forming a first potentiometric divider comprising a first branch connected to the power supply voltage and a second branch connected to the reference potential, the first and second branches having an asymmetric behaviour in response to variations in the room and/or operating temperature, the variations in operating temperature being linked to the quality of the manufacturing process of the device, said input stage supplying a first DC voltage (NBGP) with a static component and a dynamic component;

an intermediate stage, forming a resistive and capacitive filter, which receives the first DC input voltage (NGBP), eliminates its dynamic component, and supplies a second DC output voltage (NARF); and an output stage, forming a second potentiometric divider comprising a first branch connected to said power supply voltage and a second branch connected to said reference potential, the first and second branches of said second potentiometric divider having an asymmetric behaviour similar to the behaviour of the first and second branches of said first potentiometric divider, the relative voltage variations of said second divider as a function of the room and/or operating temperature being however smaller than the relative voltage variations of said first divider, the variations in operating temperature being linked to the quality of the manufacturing process, said output stage comprising in addition a logic inverter function, said output stage supplying a third DC voltage (NREF), the variations of which as a function of the room and/or operating temperature, said variations in operating temperature being linked to the quality of the manufacturing process, are the inverse of those of the said second DC voltage (NARF), said variations in the second DC voltage (NARF) being thus compensated.

2. The device according to claim 1, wherein the first branch of said input stage includes a first p-type MOS transistor (TP0) and a second n-type MOS transistor (TN0), the gate of said second transistor (TN0) and the drain of said first transistor (TP0) being connected to said power supply voltage, the source of said first transistor (TP0) being connected to the drain of said second transistor (TN0), the second branch of said input stage includes a third p-type MOS transistor (TP1) and a fourth n-type MOS transistor (TN2), the gate of said third transistor (TP1) and the source of said fourth transistor (TN2) being connected to said reference potential, the source of said third transistor (TP1) being connected to the drain of said fourth transistor (TN2), the gates of said first and fourth transistors (TP0, TN2) being connected to each other, the source of said second transistor (TN0) being connected to the drain of said third transistor (TP1) and to the gates of said first and fourth transistors (TP0, TN2), and constituting an output of the input stage.

3. The device according to claim 1, wherein said intermediate stage includes:

a first capacitive cell, comprising a fifth p-type MOS transistor (TP2) and a sixth n-type MOS transistor (TN1), the gates of said fifth and sixth transistors (TP2, TN1) being connected to each other and to the output of said input stage, the source and the drain of said fifth transistor (TP2) being connected to said power supply voltage, the source and the drain of said sixth transistor (TN1) being connected to said reference potential, a resistive cell, comprising a seventh n-type MOS transistor (TN3) and an eighth p-type MOS transistor (TP3), the gate of said seventh transistor (TN3) being connected to said power supply voltage, the gate of said eighth transistor (TP3) being connected to the reference potential, the source of said seventh transistor (TN3) and the drain of said eighth transistor (TP3) being connected to each other and to the gates of said fifth and sixth transistors (TP2, TN1) of said first capacitive cell and having a potential equal to said first DC voltage (NBGP), the drain of said seventh transistor (TN3) and the source of said eighth transistor (TP3) being connected to each other and having a potential equal to said second DC voltage (NARF), and a second capacitive cell, comprising a ninth p-type MOS transistor (TP4) and a tenth n-type MOS transistor (TN5), the source and the drain of said ninth transistor (TP4) being connected to the power supply voltage, the source and the drain of said tenth transistor (TN5) being connected to the reference potential, the gates of said ninth and tenth transistors (TP4, TN5) being connected to each other and to the drain of said seventh transistor (TN3) of said resistive cell and constituting an output of said intermediate stage.

* * * * *